US006779809B2

(12) United States Patent
Thomas et al.

(10) Patent No.: US 6,779,809 B2
(45) Date of Patent: Aug. 24, 2004

(54) FRONT RETAINING ELEMENT FOR AN ALPINE SKI BOOT

(75) Inventors: Pascal Thomas, Chambery (FR); Michel Tessot, Viuz la Chiesaz (FR); Pierre Desarmaux, Evires (FR)

(73) Assignee: Salomon S.A., Metz-Tessy (FR)

( * ) Notice: Subject to any disclaimer, the term of this patent is extended or adjusted under 35 U.S.C. 154(b) by 55 days.

(21) Appl. No.: 10/042,241

(22) Filed: Jan. 11, 2002

(65) Prior Publication Data

US 2002/0093176 A1 Jul. 18, 2002

(30) Foreign Application Priority Data

Jan. 12, 2001 (FR) ..... 01 00558

(51) Int. Cl.[7] ..... A63C 9/085
(52) U.S. Cl. ..... 280/623; 280/625
(58) Field of Search ..... 280/623, 611, 280/625, 626, 627, 628, 629, 630, 631, 633, 635, 636

(56) References Cited

U.S. PATENT DOCUMENTS

| | | | | | |
|---|---|---|---|---|---|
| 4,337,965 | A | | 7/1982 | Salomon | 280/628 |
| 4,365,822 | A | * | 12/1982 | Nitschko et al. | 280/625 |
| 4,660,849 | A | | 4/1987 | Sedlmair et al. | 280/625 |
| 4,763,908 | A | * | 8/1988 | Dimier | 280/628 |
| 4,779,892 | A | * | 10/1988 | Dimier et al. | 280/628 |
| 4,784,404 | A | * | 11/1988 | Kowatsch | 280/629 |
| 4,989,893 | A | * | 2/1991 | Kowatsch et al. | 280/625 |
| 5,044,658 | A | | 9/1991 | Challande et al. | 280/651 |
| 5,092,622 | A | | 3/1992 | Wladar et al. | 280/636 |
| 5,211,419 | A | * | 5/1993 | Gorliez et al. | 280/633 |
| 5,501,483 | A | * | 3/1996 | Stepanek et al. | 280/625 |
| 5,785,343 | A | * | 7/1998 | Challande et al. | 280/634 |
| 5,890,731 | A | | 4/1999 | Challande et al. | 280/625 |
| 5,921,573 | A | | 7/1999 | Challande et al. | 280/636 |
| 6,053,523 | A | * | 4/2000 | Quillard et al. | 280/625 |
| 6,286,856 | B1 | * | 9/2001 | Rocca | 280/634 |

FOREIGN PATENT DOCUMENTS

| | | | | |
|---|---|---|---|---|
| CH | 0464624 A1 | * | 1/1992 | A63C/9/00 |
| DE | 3913956 A1 | * | 12/1989 | A63C/9/085 |
| EP | 0126275 | | 11/1984 | |
| EP | 0653231 | | 5/1995 | |
| FR | 2420359 | | 10/1979 | |
| FR | 2640516 | | 6/1990 | |
| FR | 2651145 | | 1/1991 | |
| FR | 2663856 | | 1/1992 | |
| WO | WO 85/03451 | | 8/1985 | |

* cited by examiner

*Primary Examiner*—Brian L. Johnson
*Assistant Examiner*—J. Allen Shriver
(74) *Attorney, Agent, or Firm*—Greenblum & Bernstein, P.L.C.

(57) ABSTRACT

A retaining element for retaining the front of a boot sole on a ski. The element includes a jaw carried by a body which itself is mounted on a mounting base. The mounting base has a front zone that supports the body, and a rear zone positioned lower than the front zone. The retaining element can accept ski boots having a thicker sole.

33 Claims, 6 Drawing Sheets

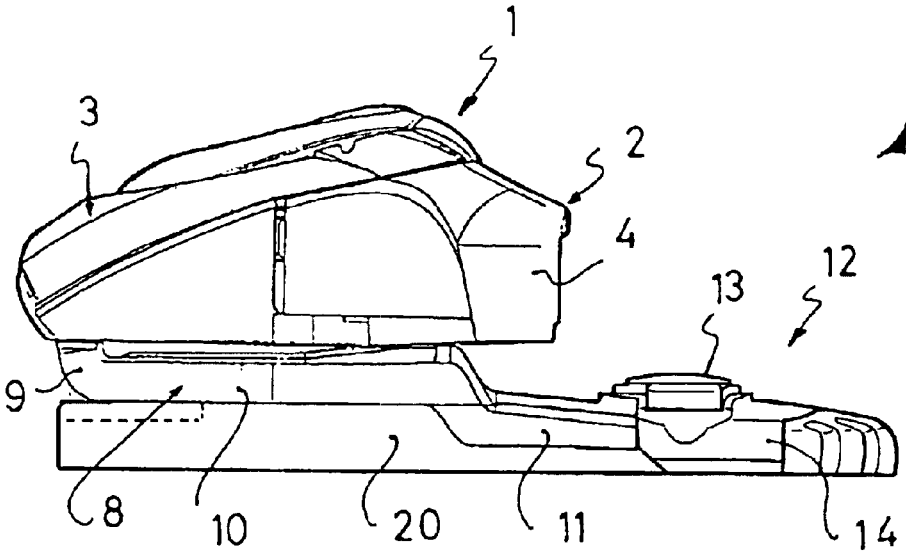
Fig. 1
Fig. 2
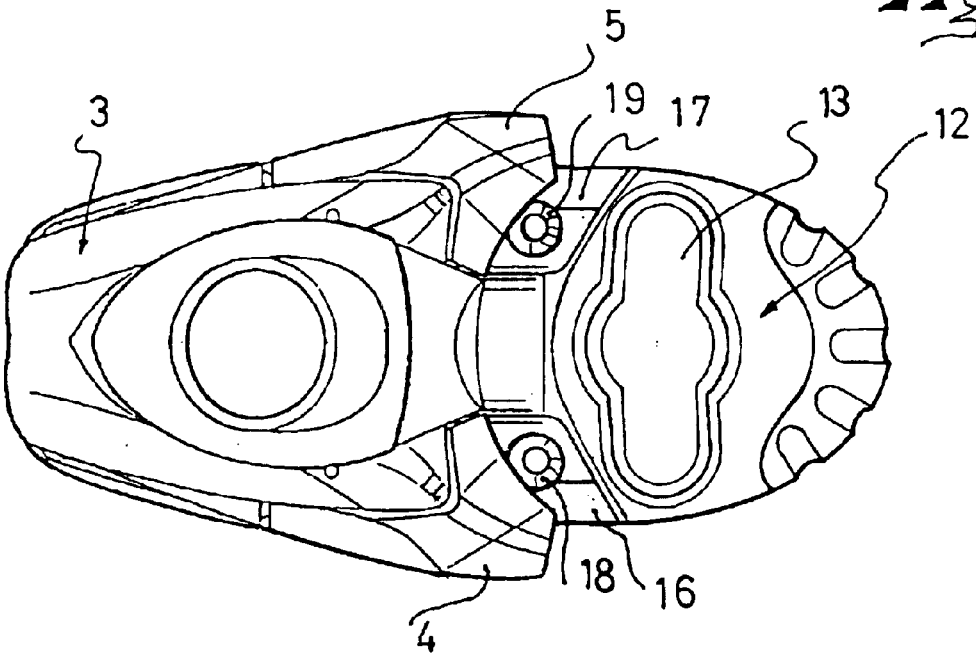

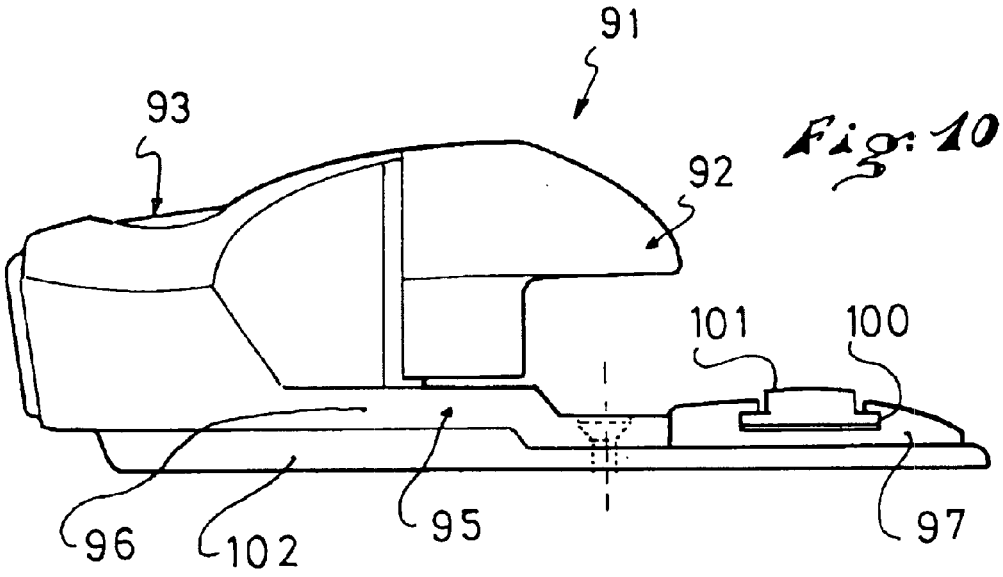
Fig: 10
Fig: 11
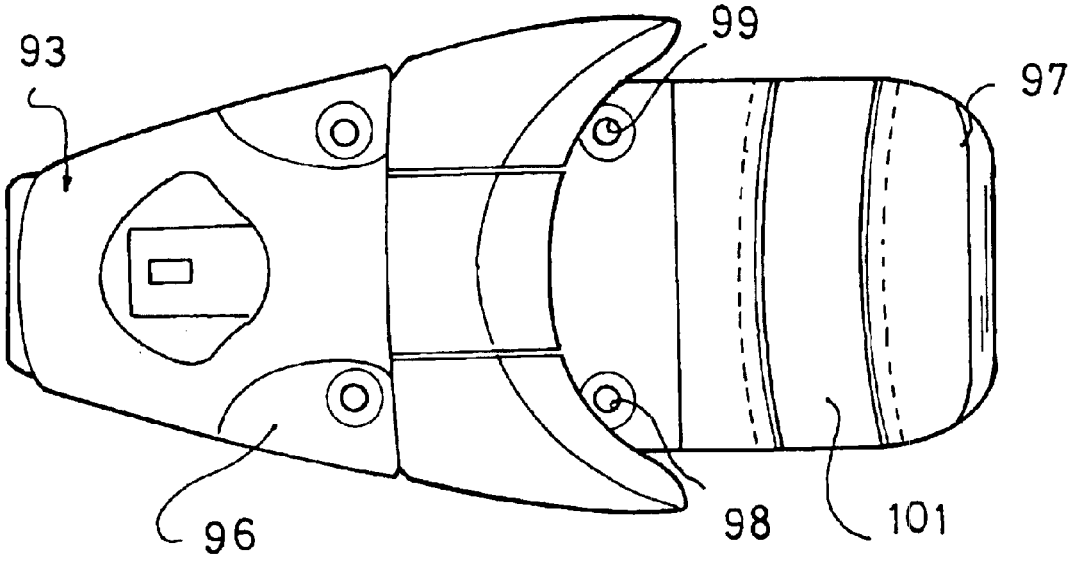

FRONT RETAINING ELEMENT FOR AN ALPINE SKI BOOT

CROSS-REFERENCE TO RELATED APPLICATION

This application is based upon French Patent Application No. 01 00558, filed on Jan. 12, 2001, the priority of which is hereby claimed under 35 U.S.C. §119.

BACKGROUND OF THE INVENTION

1. Field of the Invention

The present invention relates to an element for retaining the front of a boot on an alpine ski.

2. Description of Background and Relevant Information

A conventional alpine ski boot has front and rear end pieces by means of which the boot is retained on a ski.

Thus, the DIN 7880 standards, Part I and Part II, define the dimensions of the front and rear end pieces for boots for both adults and children, as well as the dimensions of the front and rear support surfaces of the soles of such boots.

The elements for retaining the boot, i.e., the bindings, are constructed as a function of these dimensions.

Boots constructed according to these standards are well-known for being uncomfortable and ill-adapted for walking, for example when one wishes to catch a departing ski lift.

Attempts have been made to develop and market a boot that is adapted to both walking and skiing. Thus, a flexible high boot for skiing is known from the patent document EP 126 275.

However, such a boot requires research and development for a specific retaining assembly that includes the construction of retaining elements adapted to the boot, the validation of these elements in terms of their ability to release the boot if necessary, and the introduction of this entire newly designed assembly to the public. The commercial success of such a boot therefore requires substantial investment and effort.

Another possibility includes modifying the construction of a conventional alpine ski boot to make it more comfortable for walking. However, such a solution requires also modifying the construction of the retaining elements, in particular the front element, as a function of these transformations.

SUMMARY OF THE INVENTION

In this context, an object of the invention is to propose a front retaining element, i.e., a front binding, constructed according to a known mode of construction, and modified so that it is adapted to both retain a ski boot upon a ski, as well as to facilitate walking when released from the ski.

Another object of the invention is to propose a modified retaining element in which the modifications are less substantial than those previously known.

Still another object of the invention is to propose a mode of constructing a front retaining element that can be easily applied to existing constructions.

The front retaining element according to the invention includes a jaw carried by a body which itself is mounted on a mounting base provided to be affixedly connected to the ski, a support element behind the jaw provided to receive the support of the boot sole, the mounting base having, toward the rear of the jaw, at least one bore provided for a screw for assembly to the ski, and a support element provided to receive the boot sole.

The mounting base includes two zones that extend in a common longitudinal direction, a front zone on which the body is mounted, and a rear zone that extends rearward of the jaw, in which the bore and the support element are located. The rear zone of the element is lower in relation to the front zone.

Thus, the invention proposes to modify the mounting base of the retaining element so as to raise the front zone with the body of the retaining element, the jaw and the mechanism for the elastic return of the jaw. Therefore, elements with known constructions can be used to obtain this portion of the retaining element, in particular the jaw, the body and the portion of the mounting base that supports the body. Because the jaw is raised with respect to the support element, the retaining element can receive boot soles whose front end piece has an upper edge higher than a conventional alpine ski boot. The length of the screws for assembling the retaining element which are located in the rear zone, substantially perpendicular to the jaw, is not modified significantly, which makes it possible to maintain an efficient anchoring of these assembly screws into the ski. Preferably, the support element of the retaining element is laterally movable to accompany the boot sole in the case of an excessive lateral force, independently of the relief and roughness of the sole.

BRIEF DESCRIPTION OF DRAWINGS

The invention will be better understood by means of the following description and annexed drawings, in which:

FIG. 1 shows a side view of a front retaining element according to a first embodiment of the invention;

FIG. 2 is a top view of the element of FIG. 1;

FIG. 10 shows a further embodiment of the invention; and

FIG. 11 shows a side view of the retaining element of FIG. 10.

DETAILED DESCRIPTION OF THE INVENTION

Figure 3:
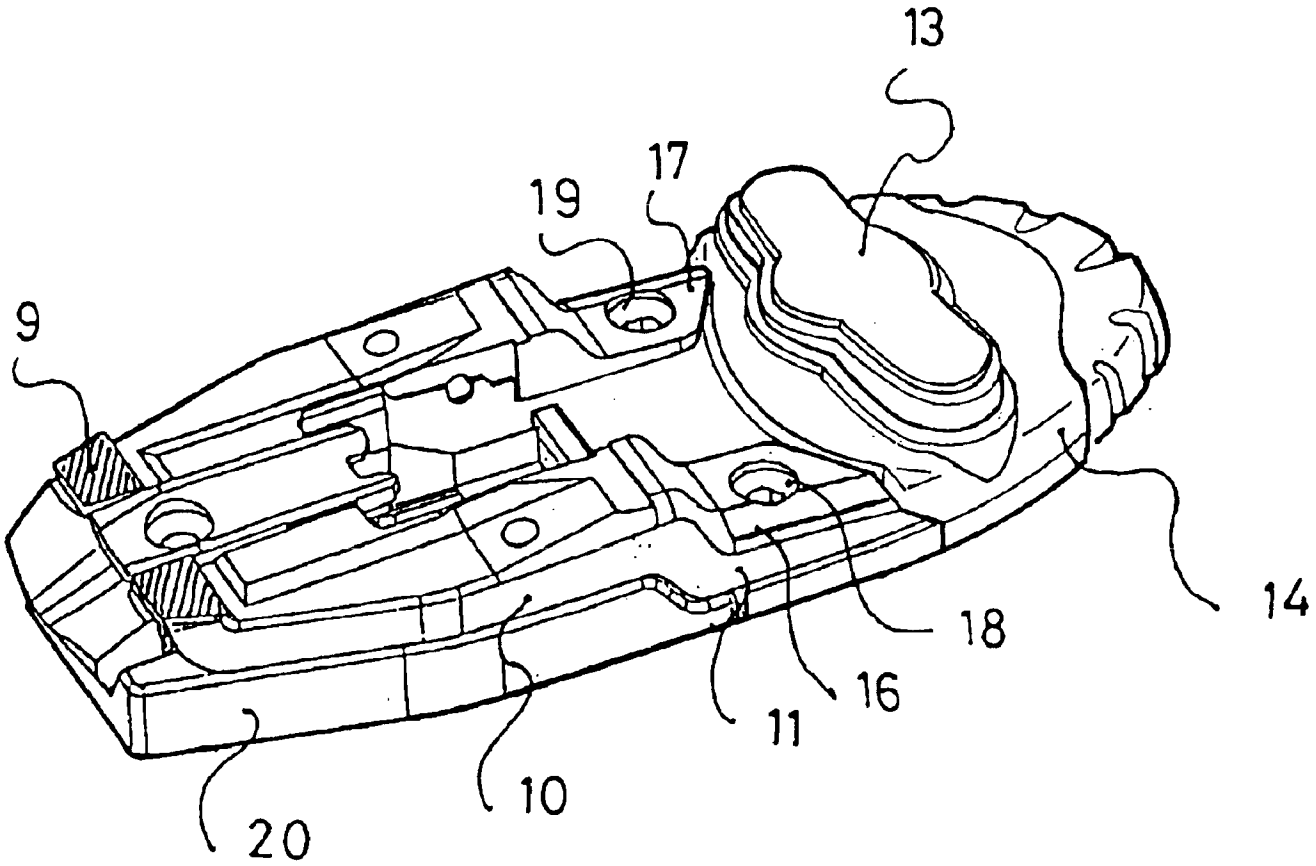
FIG. 3 is a perspective view of the mounting base of the retaining element of FIGS. 1 and 2.

FIGS. 1 and 2 show a front retaining element 1 according to a first embodiment of the invention.

The jaw 2 and the body 3 of this retaining element have a construction known primarily from the published patent application FR 2 640 516 and U.S. Pat. No. 5,044,658, the disclosure of the latter being hereby incorporated by reference thereto in its entirety. According to this mode of construction, the two wings 4 and 5 of the jaw are separate and are connected to the body 3 by vertical journal axles. They are elastically returned to the position for retaining the boot by a spring housed in the body. The wings further have a sole clamp for vertically retaining the boot.

The body 3 is mounted on a mounting base 8. It forms an integral or unitary piece together with the mounting base, and it is connected to the body by an elastically deformable zone 9 forming an elastic hinge.

According to the invention, the mounting base 8 includes a front zone 10 that is extended rearwardly by a rear zone 11.

The front zone 10 extends beneath the body 3 and includes the elastically deformable zone 9 for connecting to the body. Under these conditions, the front zone 10 supports the body.

The rear zone 11 is perpendicular to the jaw 2, or substantially perpendicular thereto, and extends toward the rear where it is extended by a movable support element 12 that is provided to support the boot sole.

According to the embodiment shown, the support element 12 is covered with a sliding pad 13. It is also movable by rocking laterally about a median longitudinal and horizontal axle carried by its support 14. Various constructions of such a support element are suitable, and among them that which is described in the patent document EP 653 231 and U.S. Pat. No. 5,890,731, the disclosure of the latter being hereby incorporated by reference thereto in its entirety, but particularly with respect to the construction of the support element. Other modes of construction are also suitable.

According to the embodiment shown, the rear zone 11 of the mounting base 8 includes two parallel arms 16 and 17, each bored with a housing 18, 19 for a screw for assembly to the ski.

The front zone 10 has an upper surface that is raised in relation to that of the rear zone, so that the body 3 and the jaw 2 are raised in relation to the upper surface of the support element 12.

An assembly screw is also provided for the front zone. A known assembly mode, especially that described in the aforementioned FR 2 651 145 and U.S. Pat. No. 5,211,419, the latter being hereby incorporated by reference thereto, can be used.

As can be seen in FIG. 1, the raising of the zone 10 results from the lowered position of two arms 16 and 17 of the zone 11. Good results can be obtained with the rear zone 11 of the mounting base being 6 millimeters, or approximately 6 millimeters, below the level of the front zone. This particular value is only provided for guidance. A height between 4 and 10 millimeters is also suitable.

Preferably, the upper surface of the support element, on which the boot sole rests, projects upwardly in relation to the portion of the mounting base below so that the sole is properly cleared height-wise. In the embodiment shown, the upper surface of the support element projects by approximately 4 millimeters in relation to the portion of the base below, and the vertical distance between this upper surface and the sole clamp of the jaw is about 24 millimeters. This distance determines the appropriate thickness of the boot sole for this retaining element. A distance of 20–28 millimeters could also be used.

Optionally, a two-level spacer or wedge 20 can be further positioned beneath the two zones of the mounting base 8 to take into account the difference in their levels.

This wedge 20 has an extension that extends the bottom-most level and which extends beneath the zone of the support element 12 to form the support 14.

The result from this mode of construction is that the body, the zone 10 of the mounting base that supports the body, the jaw, and the mechanism for the elastic return of the jaw have substantially the same construction as for an already known retaining element. It is advantageous that the front zone of the mounting base not be modified in its function of supporting the body; indeed, this zone contributes to the strength of the body.

The jaw 2 is higher in relation to the support element. This retaining element is therefore adapted to receive boot soles having a sole front end piece thicker than a conventional alpine ski boot, or at least a higher sole upper edge than for a conventional alpine ski boot. The rear assembly screws housed in the bores 18 and 19 are located substantially perpendicular to the jaw. As a result, their position is well-adapted for supporting the upward vertical biases which the boot exerts on the jaw. As the rear zone 11 is not affected by the raising of the front zone, the assembly screws maintain a substantially constant length, in particular the height of the screw head with respect to the ski is not modified, resulting in an efficient anchoring of the screws into the ski. The front anchoring of the retaining element is substantially modified due to the raising of the front zone. However, the biases to which this zone is subject are relatively low.

The movable support element facilitates the release of the boot in the case of a fall combined with a twisting component.

Figure 4:
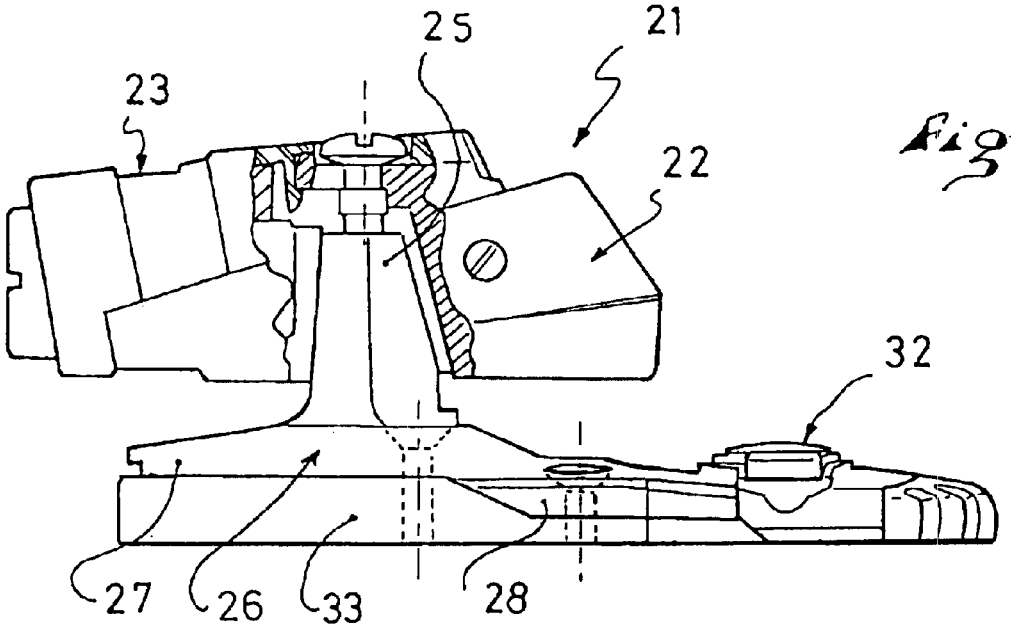
FIG. 4 shows an alternative embodiment of the invention.

According to FIG. 4, the front retaining element 21 has a jaw 22 forming an integral assembly together with the body 23, as is described, for example, in patent document FR 2 420 359 and U.S. Pat. No. 4,337,965, the disclosure of the latter being hereby incorporated by reference thereto in its entirety. The body 23 is pivotally mounted with respect to a pivot 25 mounted on a mounting base 26 provided to be affixedly connected to the ski. The body and the jaw are returned to the centered position by a spring housed in the body.

As in the preceding case, the mounting base 26 includes two zones, a front zone 27 that carries the pivot 25 and a rear zone 28 that is lower than the zone 27.

Figure 5:
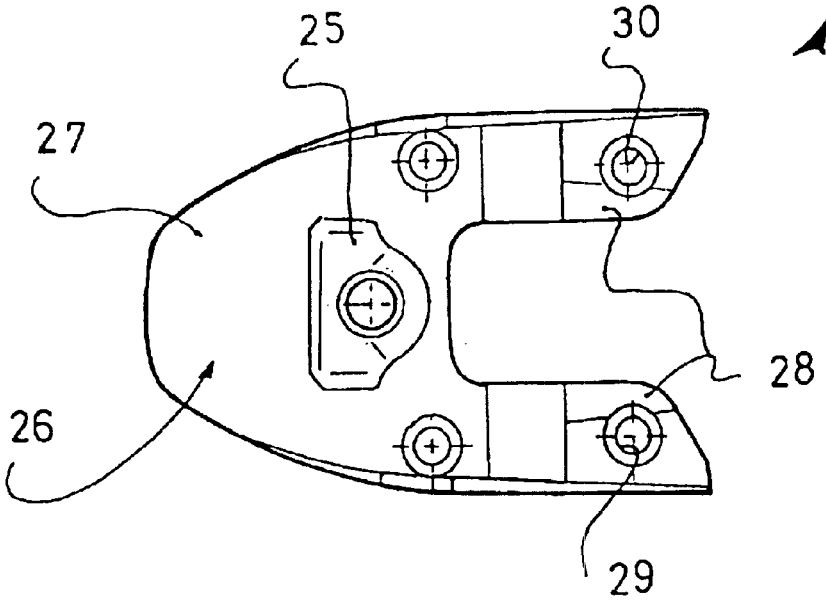
FIG. 5 shows a top view of the mounting base of FIG. 4 and its pivot.

As is visible in FIG. 5, the rear zone 28 is formed of two parallel arms, and each of the arms is bored with an opening 29, 30 for a screw for assembly to the ski. These openings are substantially perpendicular to the retaining jaw.

The retaining element 21 is associated with a support element 32 that has substantially the same construction as the preceding element 12.

Thus, with a minor modification, the retaining element 21 accepts boots having a raised edge at the sole front end piece.

The mounting base 26 and the support element 32 are mounted as in the preceding case on a spacer or wedge 33 having two levels, one for the front zone 26 and the other for the rear zone 28 and the support element 32.

Figure 6:
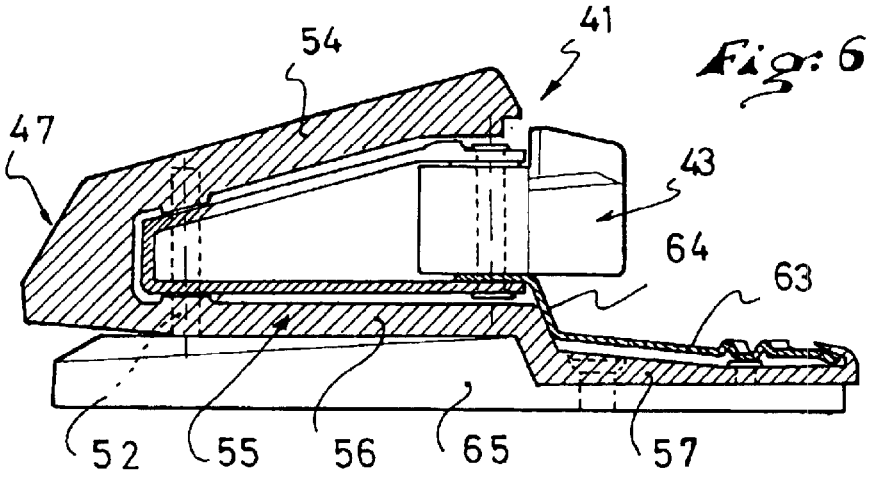
FIG. 6 shows a side view of another alternative embodiment.
Figure 7:
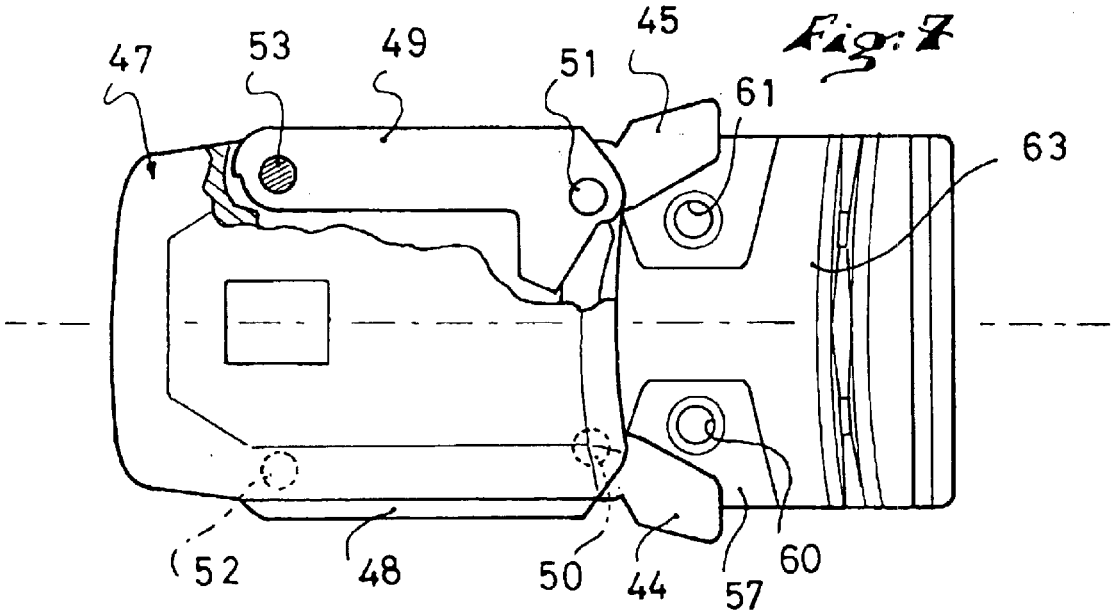
FIG. 7 shows a top view of the retaining element of FIG. 6.

According to the mode of construction shown in FIGS. 6 and 7, the retaining element 41 is constructed with a jaw 43 formed of two wings 44 and 45 which are laterally movable with respect to a body 47, as is described in the patent application WO 85/03451 and U.S. Pat. No. 4,660,849, the disclosure of the latter being hereby incorporated by reference thereto in its entirety.

According to this mode of construction, the wings 44 and 45 are connected to arms 48, 49 about pivots 50, 51. The arms 48 and 49 themselves are connected to the body about pivots 52 and 53 located at the front of the body. The assembly is returned to the centered position by a return spring housed in the body.

The body 47 here is essentially formed of an upper cover 54 and of a mounting base 55 that are coupled to one another at the front of the arms.

The mounting base 55 has a front zone 56 and a lower rear zone 57 that is perpendicular to, or substantially perpendicular to, and behind the jaw.

In the rear zone 57 of the mounting base are two bores 60 and 61 each provided for a screw for assembly to the ski.

The retaining element 41 has a support element 63 movable with the jaw 43. According to the embodiment shown, the support element 64 is metallic; it is formed of a shaped metal sheet that rests freely on the rear zone 57 of the mounting base. At the front, the support element has an upward bend 64 that corresponds to the difference in level between the two zones of the mounting base, and it is affixedly fixed to the jaw, at the junction between the arms and the wings.

Preferably, the mounting base 55 itself rests on a two-level spacer or wedge 65.

Thus, the element 41 can accept boots with a sole that is thicker at the front.

Figure 8:
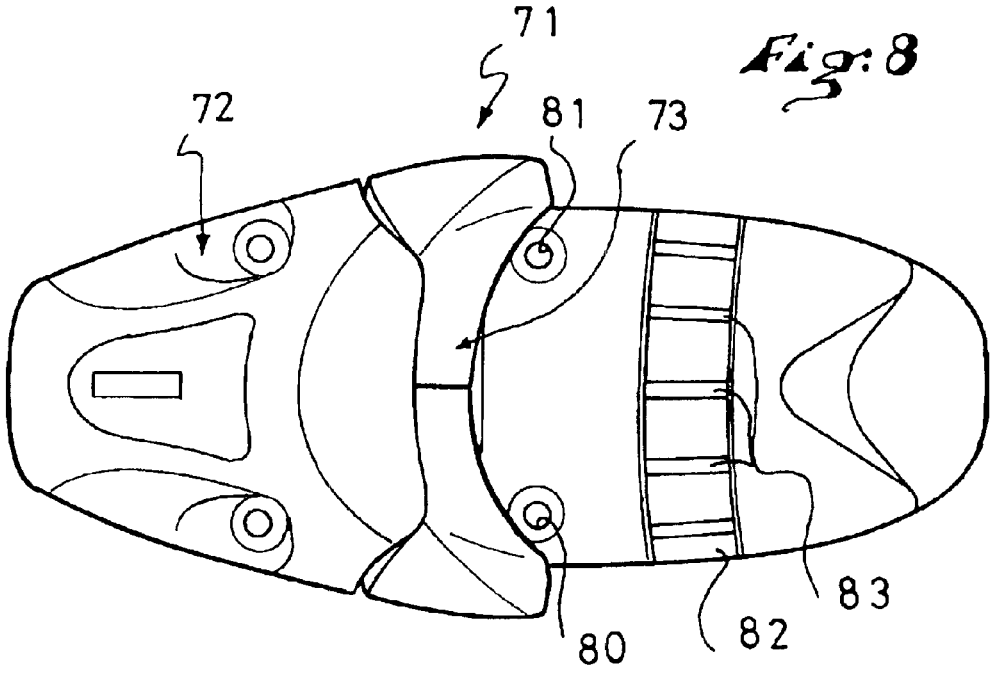
FIG. 8 relates to yet another alternative embodiment.
Figure 9:
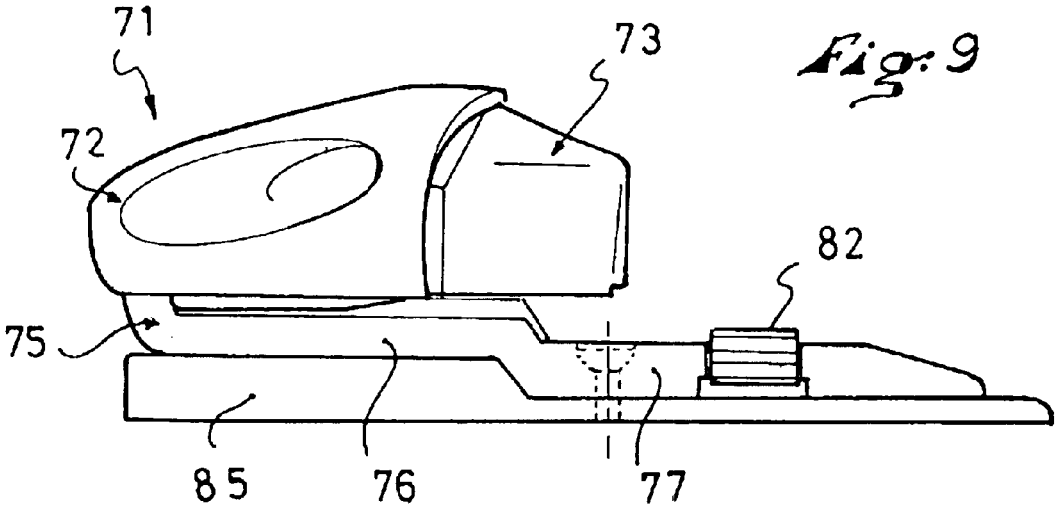
FIG. 9 is a side view of the retaining element of FIG. 8.

According to the alternative construction of FIGS. 8 and 9, the retaining element 71 includes a body 72 and a retaining jaw 73 formed of two independent wings journalled with respect to the body and returned by a spring housed in the body. The body is mounted on a mounting base 75 that includes, as the preceding mounting bases, a front zone 76 and a lower rear zone 77. The rear zone extends rearwardly of the retaining jaw, and it has two bores 80 and 81 for screws for assembly to the ski.

A support device is provided to support the boot sole. It includes an endless band 82 with projecting notches 83. The endless band is guided in a transverse channel, and it slides on a support obtained by reducing the cross-section of the rear zone 77 of the mounting base.

The retaining element preferably rests on a two-level spacer or wedge 85.

Another alternative construction is proposed in FIGS. 9 and 10. The retaining element 91 which is shown therein includes a body 93 and a jaw 92 formed of two wings that are movable in relation to the body. The body 93 is mounted on a mounting base 95 that includes a front zone 96 and a rear zone 97.

The rear zone, which is lower than the front zone, is bored with two openings 98 and 99 substantially perpendicular to the jaw, which are provided for screws for assembly to the ski.

Toward the rear, the zone 97 also has a transverse groove 100 in which moves a support element 101 whose upper surface projects with respect to the remainder of the mounting base.

It is on this surface that the boot sole rests. The support element 101 can move laterally with the boot, and it is returned to the centered position by a return spring.

The mounting base 95 is mounted on a two-level spacer or wedge 102.

Thus, with relatively small modifications, the retaining element 91 is capable of receiving boots having a thicker sole than a conventional ski boot.

The present description is provided for guidance only, and other embodiments of the invention could be adopted without departing from the scope thereof.

In particular, the number of screws which assemble the front or rear zone of the mounting base to the ski is not restrictive.

What is claimed is:

1. A retaining element to retain a front end of a sole of a ski boot, said retaining element comprising:

a mounting base including a front zone and a rear zone, the front zone being raised with respect to the rear zone by a distance of between 4 and 10 millimeters compared to front and rear zones of a retaining element constructed to receive boots according to standard DIN 7880 Parts I and II;

a support device to support the boot sole, the support device being positioned on the rear zone of the mounting base;

a body positioned on the front zone of the mounting base;

a jaw supported by the body, the jaw having a sole clamp for vertical retention of the boot sole, the rear zone of the mounting base extending rearward of the jaw.

2. A retaining element according to claim 1, wherein the vertical distance between the upper surface of the support device and the sole-clamp is comprised between 20 and 28 millimeters.

3. A retaining element according to claim 2, wherein the vertical distance between the upper surface of the support device and the sole-clamp is approximately 24 millimeters.

4. A retaining element according to claim 1, wherein the rear zone of the mounting base has two substantially parallel arms that are lower in relation to the front zone.

5. A retaining element according to claim 1, wherein the mounting base rests on a two-level spacer.

6. A retaining element according to claim 1, wherein the support device is constructed to be movable.

7. A retaining element according to claim 6, wherein the support device is a support element mounted for rocking movement about a median longitudinal and horizontal axle carried by a support.

8. A retaining element according to claim 6, wherein the support device is a support element movable laterally on both sides of a centered position.

9. A retaining element according to claim 6, wherein the support device is an endless band sliding on a zone of reduced cross-section of the rear zone of the mounting base.

10. A retaining element according to claim 5, wherein said two levels of said spacer have respective upper surfaces differing in height by said distance of between 4 and 10 millimeters.

11. A retaining element according to claim 1, further comprising at least one bore in the rear zone of the mounting base for receiving at least one screw for assembling the mounting base with respect to the ski.

12. A retaining element according to claim 11, wherein the mounting base has a unitary construction.

13. A retaining element according to claim 11, wherein the mounting base and the body are formed in a unitary construction.

14. A retaining element according to claim 11, wherein the front and rear zones of the mounting base extend along a common longitudinal direction.

15. A retaining element to retain a front end of a sole of a ski boot, said retaining element comprising:

a mounting base including a front zone and a rear zone;

a support device having an upper surface to support the boot sole, the support device being positioned on the rear zone of the mounting base;

a body positioned on the front zone of the mounting base;

a jaw supported by the body, the jaw having a sole clamp for vertical retention of the boot sole, the rear zone of the mounting base extending rearward of the jaw;

the upper surface of the support device and the sole clamp being spaced apart vertically by a distance within a range of between greater than 20 millimeters to 28 millimeters.

16. A retaining element according to claim 15, wherein the upper surface of the support device and the sole clamp are spaced apart vertically by a distance of approximately 24 millimeters.

17. A retaining element according to claim 15, further comprising at least one bore in the rear zone of the mounting base for receiving at least one screw for assembling the mounting base with respect to the ski.

18. A retaining element according to claim 17, wherein the mounting base has a unitary construction.

19. A retaining element according to claim 17, wherein the mounting base and the body are formed in a unitary construction.

20. A retaining element according to claim 17, wherein the front and rear zones of the mounting base extend along a common longitudinal direction.

21. A retaining element according to claim 17, wherein the front zone is raised with respect to the rear zone by a distance of between 4 and 10 millimeters compared to front and rear zones of a retaining element constructed to receive boots according to standard DIN 7880 Parts I and II.

22. A retaining element according to claim 17, wherein the rear zone of the mounting base has two substantially parallel arms that are lower in relation to the front zone.

23. A retaining element according to claim 17, wherein the mounting base rests on a two-level spacer.

24. A retaining element according to claim 23, wherein said two levels of said spacer have respective upper surfaces differing in height by said distance of between 4 and 10 millimeters.

25. A retaining element according to claim 17, wherein the support device is constructed to be movable.

26. A retaining element according to claim 25, wherein the support device is a support element mounted for rocking movement about a median longitudinal and horizontal axle carried by a support.

27. A retaining element according to claim 25, wherein the support device is a support element movable laterally on both sides of a centered position.

28. A retaining element according to claim 25, wherein the support device is an endless band sliding on a zone of reduced cross-section of the rear zone of the mounting base.

29. A retaining element provided to retain the front of a boot sole on a ski, said retaining element comprising:

a jaw having a sole-clamp for vertical retention of the boot sole, a body supporting the jaw, the body being mounted on a mounting base provided to be affixedly connected to the ski, the mounting base having, toward a rear of the jaw, at least one bore provided for a screw for assembling the mounting base to the ski, and a support device to receive the support of the boot sole, the mounting base including a front zone and a rear zone, the rear zone extending rearward of the jaw, the body being positioned on the front zone, the at least one bore and the support device being located in the rear zone;

the retaining element further comprising a two-level spacer, the mounting base being supported by the two-level spacer, with the rear zone of the mounting base being lower than the front zone.

30. A retaining element according to claim 29, wherein the rear zone is lower than the front zone by a distance of between 4 and 10 millimeters.

31. A retaining element according to claim 30, wherein the support device and the sole-clamp have respective surfaces vertically spaced apart by a distance of between 20 and 28 millimeters.

32. A retaining element according to claim 29, wherein the support device and the sole-clamp have respective surfaces vertically spaced apart by a distance of between 20 and 28 millimeters.

33. A retaining element according to claim 29, wherein the support device and the sole-clamp have respective surfaces vertically spaced apart by a distance of approximately 24 millimeters.

* * * * *